US006419220B1

(12) United States Patent
Pollich

(10) Patent No.: US 6,419,220 B1
(45) Date of Patent: Jul. 16, 2002

(54) METHOD OF OPERATING A SHEET-PROCESSING MACHINE

(75) Inventor: Gerhard Pollich, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/583,789

(22) Filed: May 31, 2000

(30) Foreign Application Priority Data

Jun. 1, 1999 (DE) ..... 199 25 065

(51) Int. Cl.[7] ..... B65H 5/22
(52) U.S. Cl. ..... 271/3.17
(58) Field of Search ..... 271/3.15, 199, 271/202, 215, 217, 3.17

(56) References Cited

U.S. PATENT DOCUMENTS

| | | | | |
|---|---|---|---|---|
| 4,897,017 A | * | 1/1990 | Castiglioni | 414/790.8 X |
| 5,028,201 A | * | 7/1991 | Hawthorne | 414/796 X |
| 5,263,704 A | * | 11/1993 | Kruger | 271/217 X |
| 5,265,536 A | * | 11/1993 | Millard | 101/424.2 X |
| 5,284,089 A | | 2/1994 | Buck et al. | |
| 5,931,634 A | * | 8/1999 | Neri | 414/790 X |
| 6,006,670 A | | 12/1999 | Bantlin et al. | |

FOREIGN PATENT DOCUMENTS

| | | |
|---|---|---|
| DE | 92 02 352.5 U1 | 9/1992 |
| DE | 196 13 288 A1 | 10/1997 |
| DE | 297 13 348 U1 | 10/1997 |
| DE | 197 01 645 A1 | 7/1998 |
| DE | 197 42 764 C1 | 9/1998 |
| DE | 197 16 457 A1 | 10/1998 |

* cited by examiner

*Primary Examiner*—David H. Bollinger
*Assistant Examiner*—Kenneth W Bower
(74) *Attorney, Agent, or Firm*—Laurence A. Greenberg; Werner H. Stemer; Gregory L. Mayback

(57) ABSTRACT

A method of operating a sheet-processing machine having a sheet-pile station, a sheet conveyor for feeding sheets to the sheet-pile station and for releasing the sheets thereat during operation, the sheet conveyor defining therebeneath a clearance space extending downwardly with a magnitude depending upon the operating condition of the machine, and a drive operatively connected to the sheet conveyor, which comprises detecting extents of the clearance space in a vertical direction which exceed predeterminable values, and, after the drive has been stopped, forcibly keeping the drive stopped for as long as the vertical extent of the clearance exceeds a predetermined value. In another aspect of the invention, instead of the foregoing last step of the method, there is substituted a step of forcibly reducing to a predetermined value an extent of the clearance that exceeds a predetermined value.

6 Claims, 5 Drawing Sheets

METHOD OF OPERATING A SHEET-PROCESSING MACHINE

BACKGROUND OF THE INVENTION

Field of the Invention

The invention relates to a method of operating a sheet-processing machine, having a sheet-pile station, a sheet conveyor for feeding the sheets to the pile station and for releasing them thereat during operation, the sheet conveyor defining an upper limit of a space extending beneath the sheet conveyor in the pile station and having a magnitude depending upon the operating condition of the machine, and a drive operatively connected to the sheet conveyor.

In sheet-processing printing machines such as are sold, for example, by the Heidelberger Druckmaschinen A.G., a German corporation of Heidelberg, Germany under the model designation SM102, the processed sheets form, in a sheet-pile station, sheet piles which are deposited on a lifting platform, vertically adjustable by a lifting mechanism and, in one of the possible pile-formation operating modes, rest in each case on a pile base, generally in the form of a pallet, that has been deposited on the lifting platform. Before the start of a respective print job, the lifting platform is adjusted by the lifting mechanism to such a raised position that the upper side of the yet empty pile base is located at a production level. A sheet conveyor receives the processed sheets from a last processing station of the printing machine, guides them to a level located a drop distance above the production level, over the pile base adjusted to the production level, and releases them for braking by a sheet-braking system and for subsequent pile formation. In the course of the pile formation, the lifting mechanism lowers the lifting platform automatically in a stepwise manner to the same extent as the height of the pile increases, with the result that the sheets sequentially following one another in production printing cover an essentially constant drop distance between the sheet conveyor and the production level, which is essentially maintained by the stepwise lowering of the lifting platform.

In addition to the automatic lowering of the lifting platform, a motor which actuates the lifting mechanism can also be activated manually to raise and lower the lifting platform. In particular, it is also possible for the lifting platform to be lowered completely without having a sheet pile set down thereon, thereby producing, between the lifting platform and the sheet conveyor, a clearance space that is of such a magnitude that, in particular, an operator can gain access thereto. Only when the sheet conveyor is at a standstill is this not problematic, and is even desirable inasmuch as it allows access to the clearance space in order to perform, for example, adjustments to the sheet-braking system so that braking rollers or braking belts forming the system are adapted manually to the format of the processed sheets and are adjustable, if necessary or desirable, to print-free areas of sheets printed on both sides, or in order for sheet supports provided, for example, in the form of so-called tail or nosewheels to be positioned as the conditions require.

Before a subsequent startup of the printing machine and, in particular, the sheet conveyor, an acoustic warning signal is then given in conventional printing machines in order to alert the operator working in the clearance space to leave the space and thus avert any risks posed by the sheet conveyor, which then revolves above the clearance space.

This operator-protection measure, however, also requires the operator to be vigilant and, in particular, to comply with the request, which in this case goes hand-in-hand with the latter to leave the clearance space.

SUMMARY OF THE INVENTION

It is accordingly an object of the invention is to provide a method of operating a sheet-processing machine wherein the safety risk for operators working in the region of a delivery thereof during the operation is reduced.

With the foregoing and other objects in view, there is provided, in accordance with one aspect of the invention, a method of operating a sheet-processing machine having a sheet-pile station, a sheet conveyor for feeding sheets to the sheet-pile station and for releasing the sheets thereat during operation, the sheet conveyor defining therebeneath a clearance space extending downwardly with a magnitude depending upon the operating state of the machine, and a drive operatively connected to the sheet conveyor, which comprises detecting extents of the clearance space in a vertical direction which exceed predeterminable values, and, after the drive has been stopped, forcibly keeping the drive stopped for as long as the vertical extent of the clearance exceeds a predetermined value.

In accordance with another mode, the method invention comprises forcibly stopping the drive after a prior startup thereof, if the extent of the clearance space exceeds a predetermined value.

In accordance with a further mode, the method invention comprises, after a prior startup of the drive, for an extent of the clearance space beyond a predetermined value, forcibly feeding to the sheet-pile station only those sheets which were on the way for sheet processing, and then forcibly stopping the drive.

In accordance with an added mode, the method invention comprises, during the feeding of those sheets to the sheet-pile station, which were on the way to sheet processing, preventing the extent of the clearance space from being increased in size.

In accordance with an additional mode, the method invention comprises introducing into the clearance space a divider that is bringable into and removable out of the clearance space, the extent of the clearance space being limited to a predetermined value.

In accordance with a concomitant aspect of the invention, there is provided a method of operating a sheet-processing machine having a sheet-pile station, a sheet conveyor for feeding sheets to the sheet-pile station and for releasing the sheets thereat during operation, the sheet conveyor defining therebeneath a clearance space extending downwardly with a magnitude depending upon the operating state of the machine, and a drive operatively connected to the sheet conveyor, which comprises detecting extents of the clearance space in a vertical direction, which exceed predeterminable values, and forcibly reducing to a predetermined value an extent of the clearance that exceeds a predetermined value.

Thus, in order to achieve the object of the invention, a sheet-processing machine, in particular a printing machine, having a pile station, a sheet conveyor by which the sheets can be fed to the pile station, a clearance space extending beneath the sheet conveyor and being of a magnitude which depends upon the operating condition of the machine, and a drive that is operatively connected to the sheet conveyor, is operated, in one operating mode, so that vertical extents of the clearance space which exceed predeterminable values are detected and, after stoppage of the drive, the latter is forcibly kept stopped for as long as the vertical extent of the clearance exceeds a predetermined value, while, in another operating mode, vertical extents of the clearance space which likewise exceed predeterminable values are detected, and an extent of the clearance which exceeds a predetermined value is forcibly reduced to a predetermined value.

It is frequently the case with sheet-processing printing machines that the at least one processing station of the latter, a feeder, which charges or feeds the processing station with the sheets, and the sheet conveyor of a delivery, the sheet conveyor transporting the sheets to the pile station, are in operative connection with one and the same drive, namely the main drive of the printing machine. A printing machine that is constructed in this manner and is equipped for implementing the method according to the invention thus cannot be operated if the vertical extent of the clearance beneath the sheet conveyor exceeds a predetermined value.

A preferred value of an acceptable vertical extent for startup of the printing machine is, in particular, in the order of magnitude of the dropping distance described hereinabove. If, for example, the lifting platform has not yet been charged with a pile and lowered completely, and an operator is doing, for example, preparatory work in the clearance space that is available, then the printing machine cannot be operated, with the result that the operator is not at any risk from the sheet conveyor, which includes gripper systems usually revolving during operation, gripping a respective processed sheet at the leading border thereof and, clamped in this manner, transporting the sheet to the pile station or, with the sheet run at a standstill, revolving in empty condition.

It is possible to start up the printing machine again only when the clearance space beneath the sheet conveyor has had the vertical extent thereof reduced to a predetermined acceptable magnitude. In the case assumed here of the lifting platform not yet having been charged with a pile and lowered completely, it is possible, for example, for the lifting platform to be raised, for the reduction of the clearance space, by corresponding manual activation of the aforementioned lifting-mechanism actuating motor so that the upper side of a pile base or board deposited on the lifting platform assumes the aforedescribed production level if preferably the sheet-dropping distance provided for the production printing constitutes a predetermined acceptable magnitude of the vertical extent of the clearance space.

A vertical extent of the clearance space which has been predetermined as acceptable in this way has indeed proven advantageous for the process control of the printing machine because, upon a startup of the latter, the sheet-dropping distance provided for the formation of a pile is already present; however, as regards safety, i.e., the screening of the sheet conveyor at such a height beneath the latter that an operator is not at any risk therefrom, larger vertical extents of the clearance space are also quite acceptable. At least any such extent wherein, depending upon the conception of a delivery including the sheet conveyor, access to the sheet conveyor is ruled out may be considered to be acceptable.

If, for example, when a given height of a pile formed from the processed sheets has been attained, the feeding of sheets to the printing machine is interrupted, the printing machine is switched into the "printing off" operating condition or state thereof, the pile is removed from the pile station, with the lifting platform lowered completely for this purpose, and the lifting platform is provided with an empty pile base or board and raised to the production level again, then during this time, with the sheet conveyor coupled to the main drive of the printing machine, the gripper systems continue to revolve, but without transporting any sheets. In this case there is no risk of gripper systems at a standstill unexpectedly beginning to revolve, and immediate danger posed by the revolving gripper systems can clearly be seen so that it is probable that no operator will be directly exposed to this danger. However, in order to avoid any risks, one development preferably provides for forced stoppage of the drive following prior startup thereof if the extent of the clearance space exceeds a predetermined maximum acceptable value.

In the foregoing case, wherein a pile is transported away from the pile station, the clearance space is unacceptably exceeded at the latest when the pile which is to be removed has left the pile station, and the situation remains until an empty pile base or board has been raised to the production level.

In the described process, the interruption in the feeding of sheets to the printing machine takes place before the upper side of the pile, in particular by corresponding manual activation of the motor of the lifting mechanism, provided for lifting and lowering the lifting platform, with the lifting platform being lowered, reaches a level corresponding to an acceptable extent of the clearance space, and the lowering takes place after those sheets which are on the way to processing, after the interruption in the feeding of the sheets, are transferred to the pile.

In particular, due to the possibility of activating the motor of the lifting mechanism manually, it is also conceivable for an unacceptable extent of the clearance space to be present in an operating state of the printing machine wherein the fed sheets are being processed. Because stoppage of the drive in such an operating state of the printing machine would adversely affect the sheets located in the printing machine at the moment of stoppage of the drive, it is further preferably provided that following prior startup of the drive, with an extent of the clearance space beyond a predetermined value, it is only those sheets which were on the way to sheet processing which are still forcibly fed to the pile station, and then the drive is forcibly stopped.

This not only takes into account the aforementioned safety aspects, but also provides conditions under which spoilage or rejects are prevented from being produced.

One development also takes into account the safety aspects and the avoidance of rejects or spoilage to the effect that, as those sheets which were on the way to sheet processing are fed to the pile station, the extent of the clearance space cannot be increased in size.

As far as the pile-forming process is concerned, this development offers the advantage that a dropping distance, present once a predetermined extent of the clearance space has been exceeded, for the rest of the sheets which are to be stacked is not increased in size, with the result that, with the extent suitably predetermined, it is possible to avoid, in particular, a leading edge of a sheet coming into contact with the surface of a preceding, already deposited sheet, which otherwise, i.e., with an increased dropping distance, may occur in that a respective sheet, during contact of the sheet-braking system, still existing in a trailing region of the sheet, with the sheet in a leading region thereof, has been lowered considerably before it is deposited on the pile.

In the case of the afordescribed method of removing a pile from the pile station and subsequently forming a pile on an empty pile base or board, the clearance space located beneath the sheet conveyor extends in a vertical direction, depending upon the operating state of the printing machine, i.e., in particular of the delivery thereof, either to the upper side of the completely lowered lifting platform or to the upper side of a pile base or board deposited thereon or, during production printing, in particular to the upper side of a sheet respectively deposited at the production level for the purpose of forming a pile. A predetermined acceptable extent of the clearance space which is provided in this case approximately in the order of magnitude of the sheet-dropping distance, and includes the dropping distance, does indeed extend down at least to the production level, but an unacceptable extent of the clearance space is produced at the latest with the removal of the pile from the pile station, during which time the lifting platform is usually lowered completely. If this pile is, for example, the single or last pile of a printing job, then the lifting platform is usually left in the lowered position until a further printing job has been processed. In order, then, for the case of an operative connection of the sheet conveyor with the main drive, to be able to operate the latter with the empty lifting platform lowered in order to reset, in particular, the processing stations of the printing machine for a further printing job, for example, in order to change the printing plates in the case of an offset printing machine, a preferred development of the method of operating the printing machine provides that, by virtue of introducing into the clearance space a divider which can be moved into and removed from the clearance space, the vertical extent of the clearance space is limited to a predetermined acceptable value.

This means that, following prior stoppage of the main drive, which in the example at hand is operatively connected to the sheet conveyor, the blocking of that main drive is eliminated again, i.e., the previously stopped sheet conveyor can be operated again without the gripper systems thereof, which revolve during operation, posing any risk.

For this manner of operating a printing machine, for example, a suitable divider is a roller blind which, with the aforedescribed manner of removing a pile from the pile station and replacing it with an empty pile base or board, can be pushed into the clearance space, along stationary guides, so that, while limiting the clearance space to an acceptable extent, in a pushed-in position of the roller blind, the latter screens the sheet conveyor to prevent access.

A maximum acceptable extent of the clearance space, the stopped drive being blocked, and/or the operating drive being stopped if the extent is exceeded, is dimensioned, for a further type of pile which has been removed from the pile station being replaced by an empty pile base, in particular so that, with the divider moved into the clearance space, the clearance space has an extent that is smaller than the maximum acceptable extent.

This further type of pile which has been removed from the pile station being replaced by an empty pile base makes it possible not to interrupt the sheet processing during this operation. A delivery that is suitable for this purpose, a so-called non-stop delivery, has, in particular, a second lifting mechanism, a so-called auxiliary lifting mechanism, which is constructed for receiving a further pile base, a so-called auxiliary pile base, so that the latter, following prior lowering of an already built-up pile, referred to in this context as the main pile, a given distance in the clearance space, can be transferred to the auxiliary lifting mechanism. The auxiliary pile base transferred to the auxiliary lifting mechanism then collects sheets otherwise dropping onto the main pile and, for this purpose, is located, after the transfer thereof to the auxiliary lifting mechanism, first of all at such a level that the first sheets collected following the transfer are received thereby essentially at the production level described hereinbefore. As this process continues, the auxiliary lifting mechanism lowers the auxiliary pile base in a stepwise manner to the same extent as the height of a pile which is referred to in this context as an auxiliary pile increases, and builds up on the auxiliary pile base.

As soon as the auxiliary pile base has been transferred to the auxiliary lifting mechanism, the main pile is removed from the pile station, and the lifting platform, which has been freed of a full pile, is provided with an empty pile base and raised to such a level that, with the removal of the auxiliary pile base from the auxiliary lifting mechanism, the auxiliary pile built up in the interim on the auxiliary pile base can be transferred to the empty pile base then located on the lifting platform.

With the further aforedescribed type of pile which has been removed from the pile station being replaced by an empty pile base, the so-called non-stop delivery, the lowering of the main pile prior to the transfer of the auxiliary pile base to the auxiliary lifting mechanism increases the vertical extent of the clearance space by the specific distance mentioned. In this case, the lowering distance is only of such a magnitude as to allow the auxiliary pile base to collect the sheets essentially at the production level formed previously by the upper side of the main pile. The extent of the clearance space following this lowering operation, and prior to the transfer of the auxiliary pile base to the auxiliary lifting mechanism, thus has a still acceptable value, with the result that this lowering operation does not require the drive which is operatively connected to the sheet conveyor to be stopped. The auxiliary pile base, which is moved over the main pile following this lowering operation, thus reduces the vertical extent of the clearance space, with the result that an acceptable value for this extent is given once again and the drive, following prior startup thereof, rather than being forcibly stopped because an acceptable value for this extent has been exceeded, thus remains in operation without an operator being in any danger.

The auxiliary pile base thereby assumes the function of the divider.

In a preferred configuration of the method, extents of the clearance space which exceed predetermined values are detected, and an extent of the clearance space which exceeds a predetermined value is forcibly reduced to a predetermined value.

This can be dispensed with in the presence of the previously described, so-called non-stop delivery wherein, in particular, the auxiliary pile carrier is positioned manually in the clearance space, because it is possible for a pile to be changed in such a delivery without any adverse effects upon the formation of a pile of sheets of satisfactory quality only when the pile which is to be replaced by an empty pile base is lowered a relatively low value until the auxiliary pile base is positioned in the clearance space, so that the resulting increased extent of the clearance space still assumes a smaller value than a maximum acceptable extent allowed from the standpoint of safety.

If no non-stop delivery is present, however, the forced introduction of the divider into the clearance space, with an extent of the clearance space that exceeds a predetermined value, offers the advantage that the sheet conveyor, driven, if necessary or desirable, via the main drive of the printing machine, and thus the printing machine as a whole are not stopped if a complete pile is removed from the pile station. Instead, with the feeding of sheets interrupted and the printing machine shifted into the "printing off" operating state, the divider forcibly introduced into the clearance space screens the gripper systems which, in this regard, revolve in an empty state.

All the acceptable vertical extents of the clearance space beneath the sheet conveyor which have been specified thus far, including a maximum acceptable extent which depends, respectively, upon the construction of the printing machine, have predeterminable values, these values being predetermined by the corresponding positioning of suitable detectors. The drive is stopped and/or kept at a standstill, in the different modes of the method described thus far, whenever the extent of the clearance space exceeds a maximum acceptable value.

Other features which are considered as characteristic for the invention are set forth in the appended claims.

Although the invention is illustrated and described herein as a method of operating a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
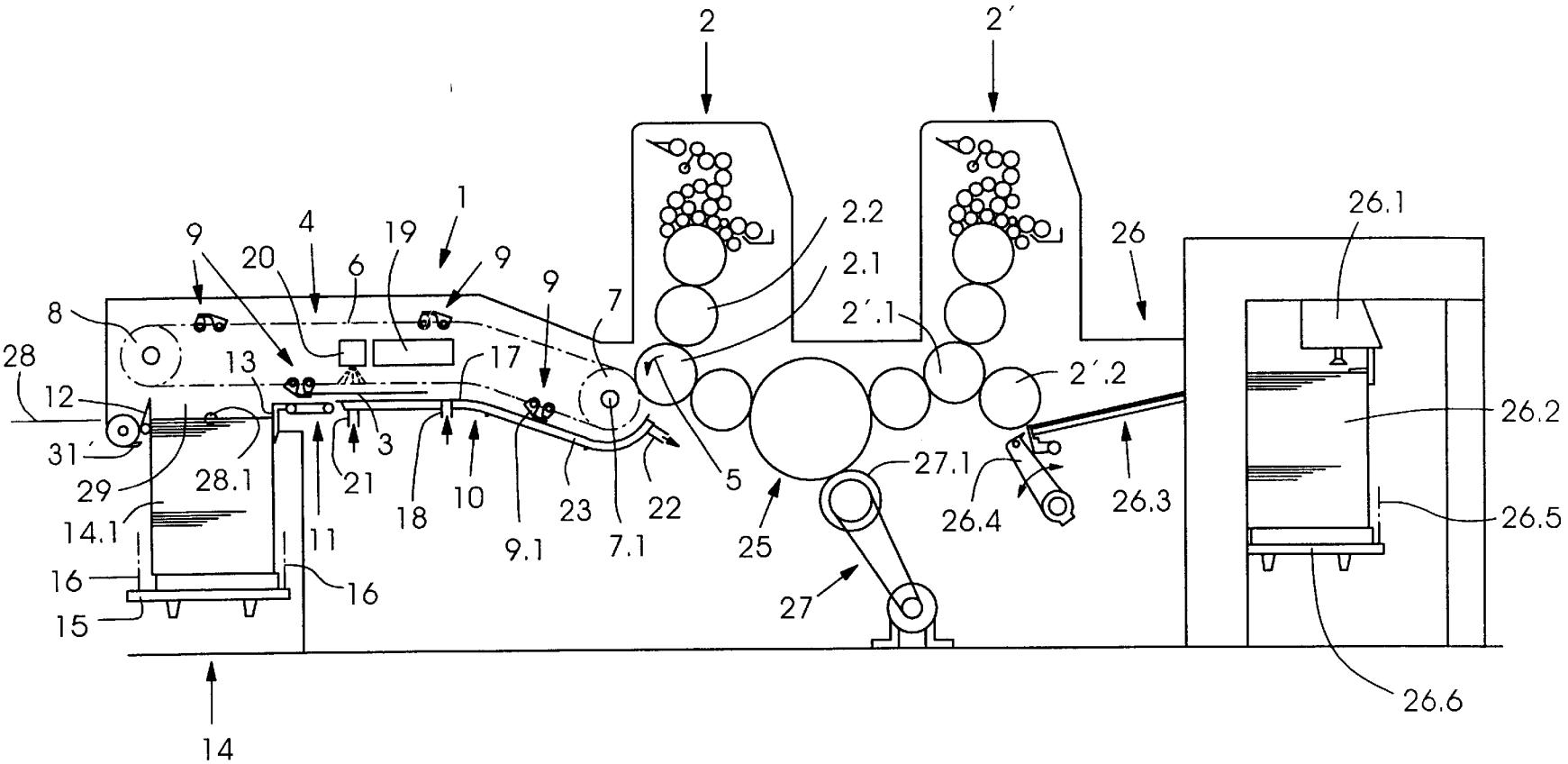
FIG. 1 is a diagrammatic side elevational view of a sheet-processing printing machine with a space divider formed, by way of example, as a roller blind, which, in this figure, is shown in a rolled-up condition.

Referring now to the drawings and, first, particularly to FIG. 1 thereof, there is shown therein a rotary printing machine illustrated, by way of example, as including a sheet delivery 1 following a last processing station. Such a processing station may be a printing unit or a post-treatment unit, for example, a coating unit. In the illustrated example, the last processing station is an offset printing unit 2 with an impression cylinder 2.1. The latter guides a respective sheet 3, in a processing direction indicated by the direction-of-rotation arrow 5, through a nip between the impression cylinder 2.1 and a blanket cylinder 2.2, which cooperates with the impression cylinder 2.1, and then transfers the sheet 3 to a sheet conveyor 4; grippers which are arranged on the impression cylinder 2.1 and are provided for gripping the sheet 3 at a gripper border at the leading end of the sheet are opened during the process. The chain conveyor 4 includes two conveying chains 6, of which, respectively, one revolves along a respective side wall of the delivery 1 during operation. A respective conveying chain 6 is looped around a respective one of two synchronously driven drive sprocket wheels 7, the axes of rotation of which are aligned with one another, and in the example of FIG. 1, is guided over a respective deflecting sprocket wheel 8 which is located downline of the drive sprocket wheels 7, as viewed in the processing direction. Extending between the two conveying chains 6 are gripper systems 9, borne by the conveying chains and provided with grippers 9.1 which pass through gaps between the grippers arranged on the impression cylinder 2.1, and thus receive a respective sheet 3, the gripper border at the leading end of the sheet 3 being gripped in the process, immediately before the grippers arranged on the impression cylinder 2.1 are opened, transport the sheet beyond a sheet-directing device 10 to a sheet brake 11 and open thereat in order to transfer the sheet 3 to the sheet brake 11. The latter imparts to the sheets a depositing speed which is lower than the processing speed and releases it once it has reached the depositing speed, with the result that a respective, then decelerated or slowed-down sheet 3 finally comes into contact with leading-edge stops 12 in a pile station 14 and, being aligned against the latter and against trailing-edge stops 13, which are located opposite the leading-edge stops, forms a pile 14.1 together with preceding and/or following sheets 3, it being possible for the pile to be lowered by a lifting mechanism to the same extent as the pile 14.1 grows. Representing the lifting mechanism FIG. 1 are only a platform 15, which bears the pile 14.1, and lifting chains 16, shown in phantom, which bear the platform 15.

The conveying chains 6, along the paths thereof between the drive sprocket wheels 7, on the one hand, and the deflecting sprocket wheels 8, on the other hand, are guided by chain-guide rails, which thus determine the paths of the chain strands. In the example of FIG. 1, the sheets 3 are transported by the chain strand that is at the bottom of FIG. 1. The section of the chain path through which that lower chain strand runs is followed alongside by a sheet-directing surface 17 that is directed towards the chain path and is formed on the sheet-directing device 10. A carrying air cushion is preferably formed, during operation, between the sheet-directing surface 17 and the sheet 3 guided away thereover, respectively. For this purpose, the sheet-directing device 10 is equipped with blowing-air or blast-air nozzles which terminate or open out into the sheet-directing surface 17 and of which only one is shown symbolically in the form of a stub 18 in FIG. 1 as a representative of all.

In order to prevent the printed sheets 3 in the pile 14.1 from sticking together, a dryer 19 and a spray powder device 20 are provided on the path of the sheets 3 from the drive sprocket wheels 7 to the sheet brake 11.

In order to avoid excessive heating of the sheet-directing surface 17 by the dryer 19, a coolant circuit or circulatory loop is integrated in the sheet-directing device 10 and is indicated symbolically in FIG. 1 by an inlet stub 21 and an outlet stub 22 on a coolant tray 23 assigned to the sheet-directing surface 17.

The sheet brake 11 includes a plurality of braking modules which are respectively formed by a suction-belt conveyor.

In the example illustrated in FIG. 1, the printing unit 2 is preceded by a further printing unit 2', so that the printing machine may be constructed for printing two colors. For printing further colors, a further printing unit is to be provided for each respective color. The printing units 2 and 2' in the illustrated example are respectively connected to one another by a sheet-transfer arrangement 25, of which, depending upon how the printing machine is set up, at least one arrangement 25 is constructed for transferring the sheets 3 in a reversed or turned condition to a following printing unit, while others thereof are constructed for transferring the sheets 3 reversing or turning them.

The printing units 2 and 2' of the illustrated exemplary embodiment are constructed for printing the sheets 3 by the so-called wet offset method.

A feeder 26 is provided for feeding sheets to the printing units 2 and 2'. The feeder 26 includes a sheet-separating or singling device 26.1 which, by lifting suckers and pull suckers, grips the respectively uppermost sheet of a sheet feed pile 26.2 and feeds it to a transporting device 26.3 which, in the illustrated example, is constructed as a suction-belt conveyor, aligns the sheets at the leading edge and a lateral edge thereof and makes them available for being received by a pregripper 26.4 which, for its part, transfers a respective sheet 3 to a feed drum 2'.2, which then transfers the sheet 3 to the impression cylinder 2'.1 of the first printing unit 2'. A lifting mechanism, which is not illustrated specifically, raises the pile 26.2 in a stepwise manner to the same extent as the height of the pile 26.2 decreases as sheets are removed continuously therefrom. The lifting mechanism is represented in FIG. 1 only by lifting chains 26.5 and a platform 26.6 that is suspended therefrom and bears the pile 26.2.

In a case wherein the printing machine is set up in a manner which that is not illustrated in FIG. 1, there is provided an auxiliary pile base or board which can be raised and lowered by a further lifting mechanism and temporarily bears the pile 26.2 which is processed down to a residual sheet pile. The auxiliary pile base and the further lifting mechanism, in this case, are constituent parts of a non-stop arrangement by which the residual sheet pile can be set down on a new pile without having to interrupt the removal of the sheets 3 by the separating device 26.1. In a particularly advantageous configuration of a non-stop arrangement for combining a residual sheet pile with a new pile, in particular the method steps necessary for this purpose, of gripping by the auxiliary pile base or board beneath the residual sheet pile and the setting down of the residual sheet pile on a new pile proceed automatically.

In the concept of the printing machine upon which the invention is based herein, by way of example, the machine has a drive 27 which, in particular, is also operatively connected to the sheet conveyor 4. For this purpose, in particular, the drive sprocket wheels 7, the cylinders of the respective printing units 2 and 2', the feed drum 2'.2 and a drum and cylinder assembly forming the sheet-transfer arrangement 25 are connected, in a rotatably fixed manner, to gearwheels so that the latter form a gear train with a respective side strand in a respective printing unit. In the diagrammatic illustration of FIG. 1, these gearwheels are illustrated in the same way as a drum respectively connected to one of the gearwheels and as a cylinder respectively connected to one of the gearwheels and as the drive sprocket wheels 7 connected to one of the gearwheels, these being fastened, for their part, on a chain-wheel shaft 7.1, common thereto. In the presented concept, a gearwheel of the sheet-transfer arrangement 25 is in engagement with a gearwheel 27.1 of the drive 27 which, for its part, is preferably connected to a motor via a toothed-belt drive.

In such a machine concept, stoppage of the sheet conveyor 4 is accompanied by stoppage of, in particular, the printing units 2 and 2', and usually also by stoppage of the components involved, on the part of the feeder 26, in feeding or charging the printing machine with sheets, because they are generally likewise operatively connected to a main drive of the printing machine, the main drive being represented herein by the drive 27.

Another concept for a printing machine, which is known, for example, from the published German Patent Document DE 41 02 472 A1, with, in particular, a separate drive for a sheet conveyor feeding the processed sheets to a pile station nevertheless also allows the sheet conveyor to be stopped without the printing machine otherwise being forcibly stopped. In particular, the printing units need not be stopped because, according to another varying aspect of the method, the feeding of the sheets is interrupted, the printing units following after one another in the processing direction are then shifted into the "printing off" operating condition thereof, and then the drive operatively connected to the sheet conveyor is stopped.

The remaining explanations refer, once again, to a machine concept which is illustrated, by way of example, in FIG. 1 and in which, in particular, the sheet conveyor is operatively connected to the main drive of the printing machine. The illustration in FIG. 1 represents the "production printing" operating condition, i.e., the printing machine is in operation, and the sheets 3 are fed, processed and deposited, in a pile station 14, on a pile 14.1 at the production level 28 already explained hereinbefore. In this operating condition, a clearance space 29 formed beneath the sheet conveyor 4 in the sheet-pile or stacking station 14 extends vertically downward to the production level 28. As a result of the lowering of the platform 15 bearing the pile 14.1, in a stepwise manner, as explained hereinbefore, in order to compensate for the growing height of the pile 14.1, the production level 28 is indeed subjected to slight fluctuations, but, due to the fact that the pile 14.1 ensures a screening of the sheet conveyor 4, the fluctuations are not significant. The production level 28 is usually sensed by a production-level detector 28.1 which is indicated in FIG. 1 and, as the pile 14.1 grows a given amount, activates the lifting mechanism to lower the pile 14.1 correspondingly. The vertical extent of the clearance space 29 thus reached has a value which is acceptable in any case, with the result that no further measures are necessary with regard to screening the sheet conveyor 4 in the operating condition represented by FIG. 1. In this regard, the sheet conveyor is screened in the pile station 14 by the pile 14.1 and otherwise by the already hereinaforementioned sheet-directing device 10.

Figure 2:
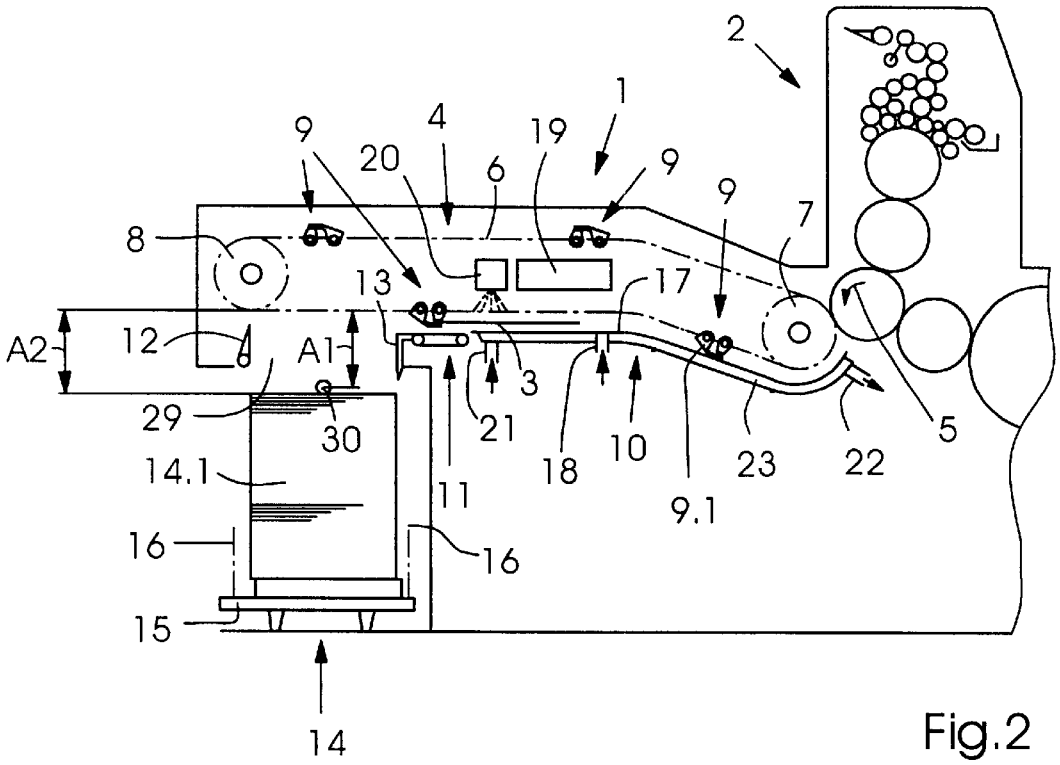
FIG. 2 is a fragmentary view of FIG. 1 showing a part of the sheet-processing printing machine which includes a sheet-pile or sheet-stacking station in an operating condition wherein a pile formed of the sheets has been made ready for transport away from the sheet-pile station.

FIG. 2 is intended to represent an operating condition of a printing machine wherein the drive 27 which, according to FIG. 1, is, in particular, also operatively connected to the sheet conveyor 4, has been stopped, the pile 14.1 has reached the full height thereof and, for the purpose of removing the sheet pile 14.1 from the pile station 14, has been lowered to a level which is envisaged for this purpose and at which the pile 14.1 can be transported away, for example, by a floor conveyor. As the pile 14.1 is lowered, a top or upper edge thereof passes a detector 30 which is positioned to the side of the pile 14.1 and is arranged beneath the sheet conveyor, at a predetermined distance A1 therefrom. The detector registers whether the pile 14.1 is located opposite it or not opposite it at the level thereof, and thus detects an increase, resulting from the lowering of the pile 14.1, in the vertical extent of the clearance space 29 beyond a predetermined value.

In the presented case according to FIG. 2, the upper side of the lowered pile 14.1 is located at a spaced distance A2 beneath the sheet conveyor 4, the distance A2 being greater than the distance A1. Thus, the vertical extent of the clearance space 29 has a value that exceeds a value predetermined by the position of the detector 30. A signal emitted by the detector 30 as the predetermined value is exceeded is processed in a non-illustrated drive control to the effect that the drive 27, which has already been stopped in the case described herein, is forcibly kept at a standstill, to be precise until the clearance 29 once again has an extent which is smaller than a predetermined value. This can be achieved, in particular, in that, once the pile 14.1 has been removed from the pile station 14, the platform 15 is charged with an empty pile base or board and is raised by the lifting mechanism which is independent of the drive 27, until the upper side of the empty pile base or board is located at the aforedescribed production level.

During this raising operation, the detector 30 registers that, finally, the empty pile base or board is located opposite it, and, accordingly, the detector 30 emits a signal which is processed by the drive control so as to release the drive 27. The printing machine can then be operated again.

Figure 3:
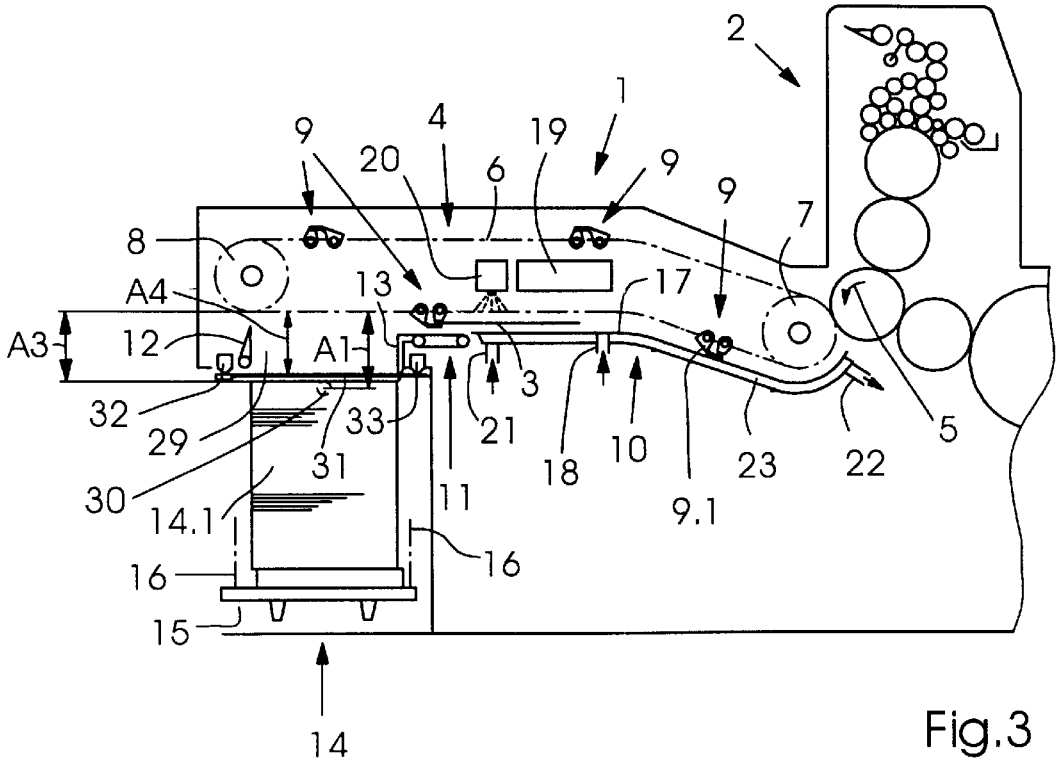
FIG. 3 is a view like that of FIG. 2, showing the sheet-pile station equipped with an auxiliary pile base or pile board for the purpose of replacing a pile by an empty pile base or board without interrupting the sheet processing.

FIG. 3 illustrates the case wherein a divider 31 is provided which is positionable as desired in the pile station 14. In the printing-machine setup illustrated in this figure, the divider 31 constitutes an aforementioned auxiliary pile base or board, with the aid of which it is possible to dispose of the complete pile 14.1 during continued conveying of sheets 3 by the sheet conveyor 4 in the manner described hereinbefore. Depending upon the setup of the printing machine, the divider 31, constructed as the auxiliary pile base or board, can be moved manually or automatically into the clearance space 29 beneath the sheet conveyor 4.

An advantageous configuration for an auxiliary pile base or board which can be actuated manually can be taught, for example, from the published European Patent Document EP 0 407 728 B1, which discloses an auxiliary pile base or board in the form of a rake, it being the case that the latter, in a rest position, is suspended pivotally opposite a side of the pile 14.1 which is oriented downline from the sheet-conveyor conveying direction, so that the free ends of the rake-forming bars are oriented upwardly and a pivot axis allowing the pivoting operation is provided in the region of the upper end of the suspended rake. In order for the divider, which is constructed and arranged in this manner, to be moved into the clearance space 29, the rake is pivoted into a horizontal position and pushed into guides which are arranged on both sides of the pile station 14 and, for their part, can be raised and lowered so that the aforedescribed production level 28 is essentially maintained as an auxiliary pile, is formed on the rake.

In FIG. 3, the divider 31 constructed, for example, as described hereinabove, but not illustrated in corresponding detail, is illustrated in a nominal or desired position in the pile station 14, wherein it performs a double function insofar as, on the one hand, it allows an auxiliary pile to be built up as the pile 14.1 is removed from the pile station 14 once the full height thereof has been attained and, on the other hand, it screens the revolving sheet conveyor 4. The divider 31 is moved into this desired or nominal position after the pile 14.1 has previously been lowered slightly so that the divider 31 can be positioned above the pile 14.1, and the upper side of the pile 14.1 has not yet passed the detector 30, i.e., after, according to FIG. 3, the extent of the clearance space 29 has assumed the value, A3 as specified in FIG. 3. The lowering operation is initiated by a signal which is emitted to a non-illustrated lifting-mechanism control, and activates the lifting mechanism by a detector 32 and is triggered by the divider 31 before the latter passes into the region of the sheets released by the sheet conveyor 4. The divider 31 is pushed into the desired or nominal position thereof, when the upper side of the pile 14.1 is located a short distance beneath the divider 31. When the desired or nominal position is attained, the divider 31 triggers a signal, via a further detector 33, the signal being processed in the aforementioned drive control so as to maintain the operation of the drive 27.

As the pile 14.1 is lowered to the extent necessary for pushing in the divider 31, the clearance space 29 increases beyond a predetermined value detected by the production-level detector 28.1. With further lowering of the pile 14.1, and with a divider 31 not being present and/or not being located in the desired or nominal position, a signal then triggered by the detector 30 if the upper side of the pile 14.1 passes the detector 30 would be processed in the drive control so as to stop the drive 27. In this respect, in the case at hand, an extent of the clearance space 29, which can be detected by the detector 30, beyond the predetermined value A1 according to FIG. 2 would be considered to be an unacceptable extent as far as safety screening of the sheet conveyor 4 is concerned. If this extent is exceeded, the drive 27, following prior startup in the case at hand, would be forcibly stopped by the drive control and, consequently, kept at a standstill for as long as the extent of the clearance exceeds the value A1. However, corresponding processing of the signal emitted by the detector 30 in this case is prevented by a signal emitted to the drive control by the detector 33 with the divider 31 in the desired or nominal position in the clearance space 29. The divider-31 located in the desired or nominal position thus limits the extent of the clearance space 29 to a predetermined acceptable value A4 according to FIG. 3. This condition is also maintained at first when the pile 14.1 is lowered beneath the detector 30 and is removed from the pile station 14, with the result that the delivery 1 can be operated as a non-stop delivery. If, as an auxiliary pile continues to be built up on the divider 31 constructed as an auxiliary pile carrier, the sheets 3 are finally deposited at the production level 28 again, then signals emitted during this time by the detectors 30 and 33 are ignored by the drive control because the extent of the clearance space 29 is detected in this case by the production-level detector 28.1 (note FIG. 1), of which the signals are processed in the lifting-mechanism control so as to maintain the production level 28. It is thus also the case that the removal of the divider 31, formed as an auxiliary pile carrier, from the desired or nominal position thereof, with an auxiliary pile formed thereon being set down on an empty pile base or board raised correspondingly by the lifting mechanism, does not cause the drive 27 to be stopped.

The explanations relating to FIG. 3 in this respect are based upon the fact that the divider 31 thereat is movable manually into the desired or nominal position thereof.

In a printing-machine setup differing therefrom, an auxiliary pile base or board of a non-stop delivery, the auxiliary pile base or board being used in the method according to the invention as a divider, can be moved automatically between a rest position and the desired or nominal position and is thus operatively connected to a divider drive which can be activated by a divider control. One of the possible exemplary embodiments of a divider which can be moved automatically is disclosed in the published German Patent Document DE 42 44 383 A1.

In a preferred configuration of a printing machine with a divider which can be moved automatically in the manner mentioned hereinabove, there is a link between the divider control and a detector which, when an extent of the clearance space 29 exceeds a predetermined value, emits a signal to the divider control which, in response to this signal, activates the divider drive to move the divider from a rest position thereof into the desired or nominal position thereof in the pile station. For the link, use is made of a detector which is positioned so that it emits the signal when an extent of the clearance space 29 which allows the divider to be moved out of the rest position thereof into the desired or nominal position thereof without collision is exceeded. The detector 30 may be used for this purpose in the example according to FIG. 3.

With this configuration of a printing machine, it is thus the case that, regardless of whether the divider thereof is used as an auxiliary pile base or board of a non-stop delivery or not, by virtue of the divider 31 being forcibly moved from the rest position thereof into the desired or nominal position thereof, an extent of the clearance space 29 which exceeds a predetermined value is forcibly reduced to a predetermined value if extents of the clearance space which exceed predetermined values are detected. This reduction is accompanied by screening of the sheet conveyor and also takes place irrespective of whether the drive 27 operatively connected to the sheet conveyor is in operation or not.

In a printing machine which does not have a non-stop delivery, a divider which can be moved forcibly from a rest position into the desired or nominal position is constructed, for example, in the form of a roller blind. FIG. 1 indicates such a divider 31' which, in the example at hand, is constructed in a manner similar to a roller shutter which can be rolled out horizontally. While a divider provided as an auxiliary pile base or board, as has been mentioned hereinbefore, can be raised and lowered in the pile station by an auxiliary lifting mechanism, it is possible to dispense with a vertical adjustment of a divider which can be moved into a desired or nominal position in the pile station, the sheet conveyor 4 being screened in this position, exclusively for safety reasons and, as has been explained, preferably forcibly. Accordingly, the roller-shutter casing of the divider 31' according to FIG. 1 is arranged at a fixed level which is selected so that the roller blind, in the desired position thereof, limits the vertical extent of the clearance space 29 to an acceptable predetermined value. In order to support the extensible part of the roller blind used as the divider 31', stationary guide rails (not illustrated in FIG. 1) are provided on both sides of the pile station.

It is readily understandable that the aforedescribed dividers are dimensioned so that, in the desired or nominal position thereof, they screen the sheet conveyor 4 to an extent that it is not already screened by the sheet-directing device 10, which is adjoined by a changeable-length section that is not illustrated in FIGS. 1 to 3 and is located downline, as viewed in the conveying direction of the sheets 3. The section extends up to the sheet brake and varies the length thereof by a respective displacement distance along which the sheet brake 11 is adjusted, for adaptation to the format of the sheets 3, to different positions along the sheet conveyor 4. In the case of the divider 31 being constructed in the form of an auxiliary pile base which constitutes a rake, the distance between the rake-forming bars is selected so that accidental through-passage through gaps present between the bars is prevented.

Examples of detectors which may be used are, in particular, capacitive sensors and reflection light barriers. For the purpose of detecting the desired or nominal position of the divider 31 or 31', it is possible to use, in particular, a limit switch.

Figure 4A:
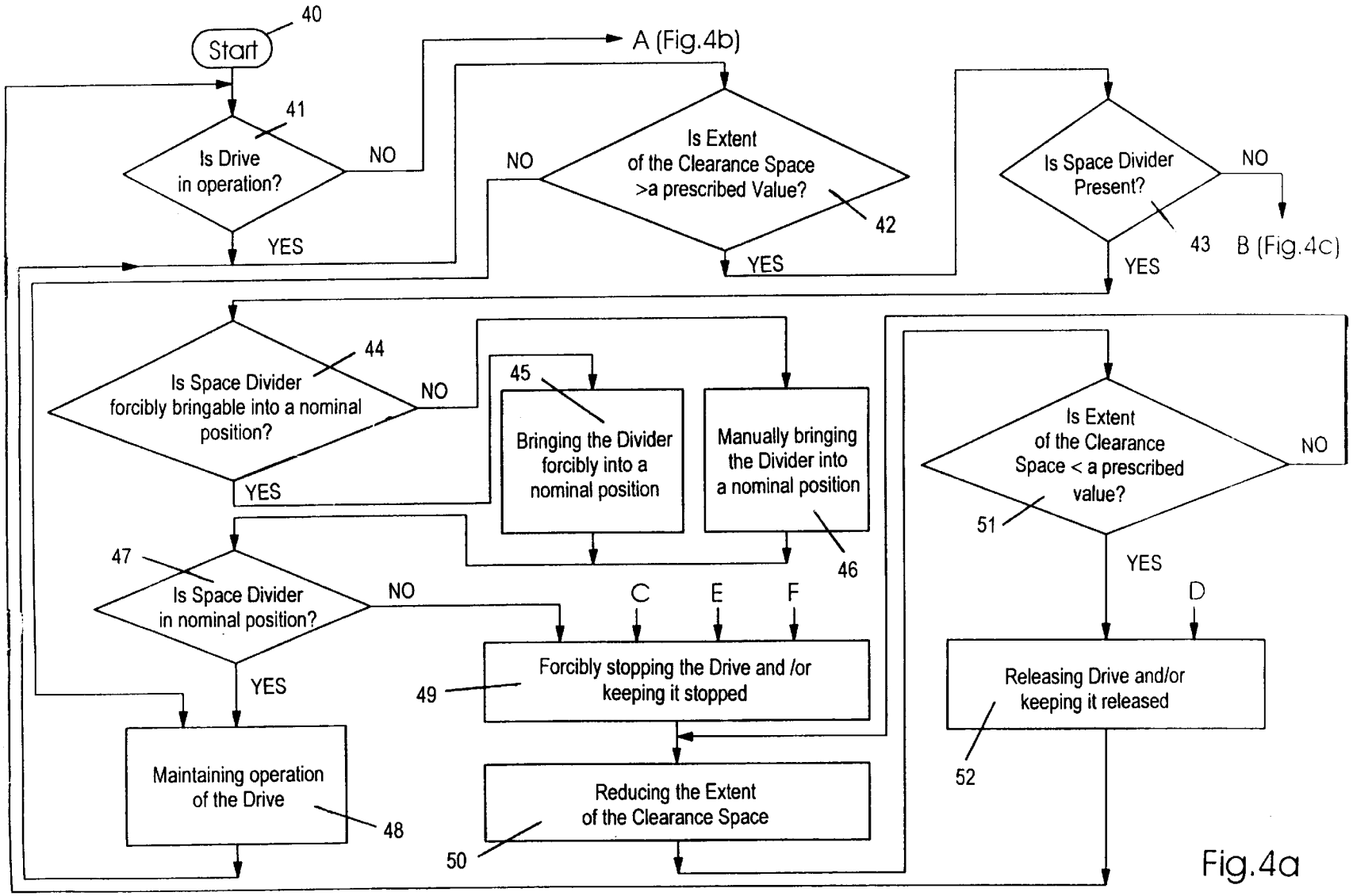
FIGS. 4*a* to 4*c* are flow diagrams depicting the operation of a sheet-processing printing machine, taking into account various setups thereof.
Figure 4B:
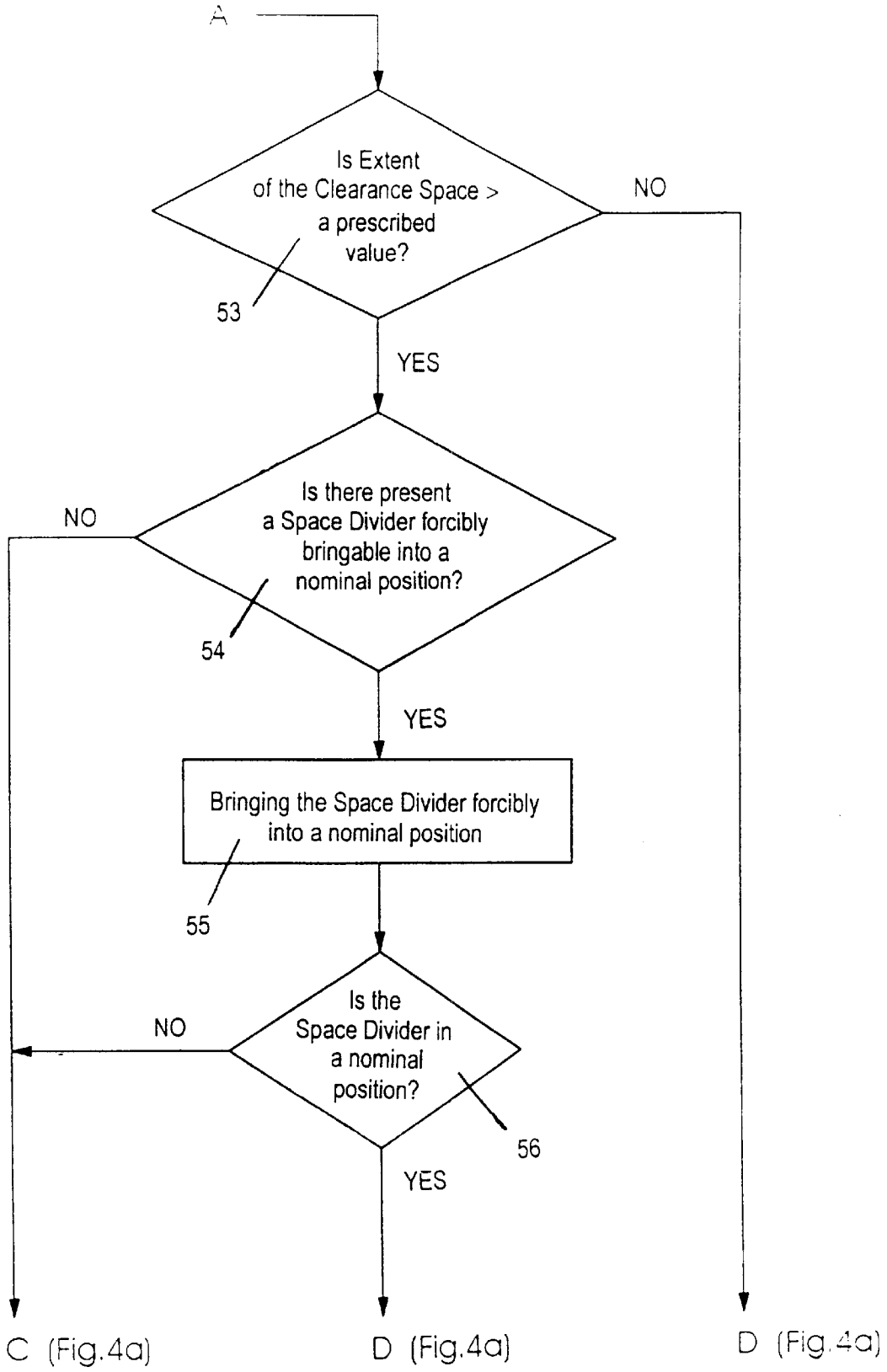
Figure 4C:
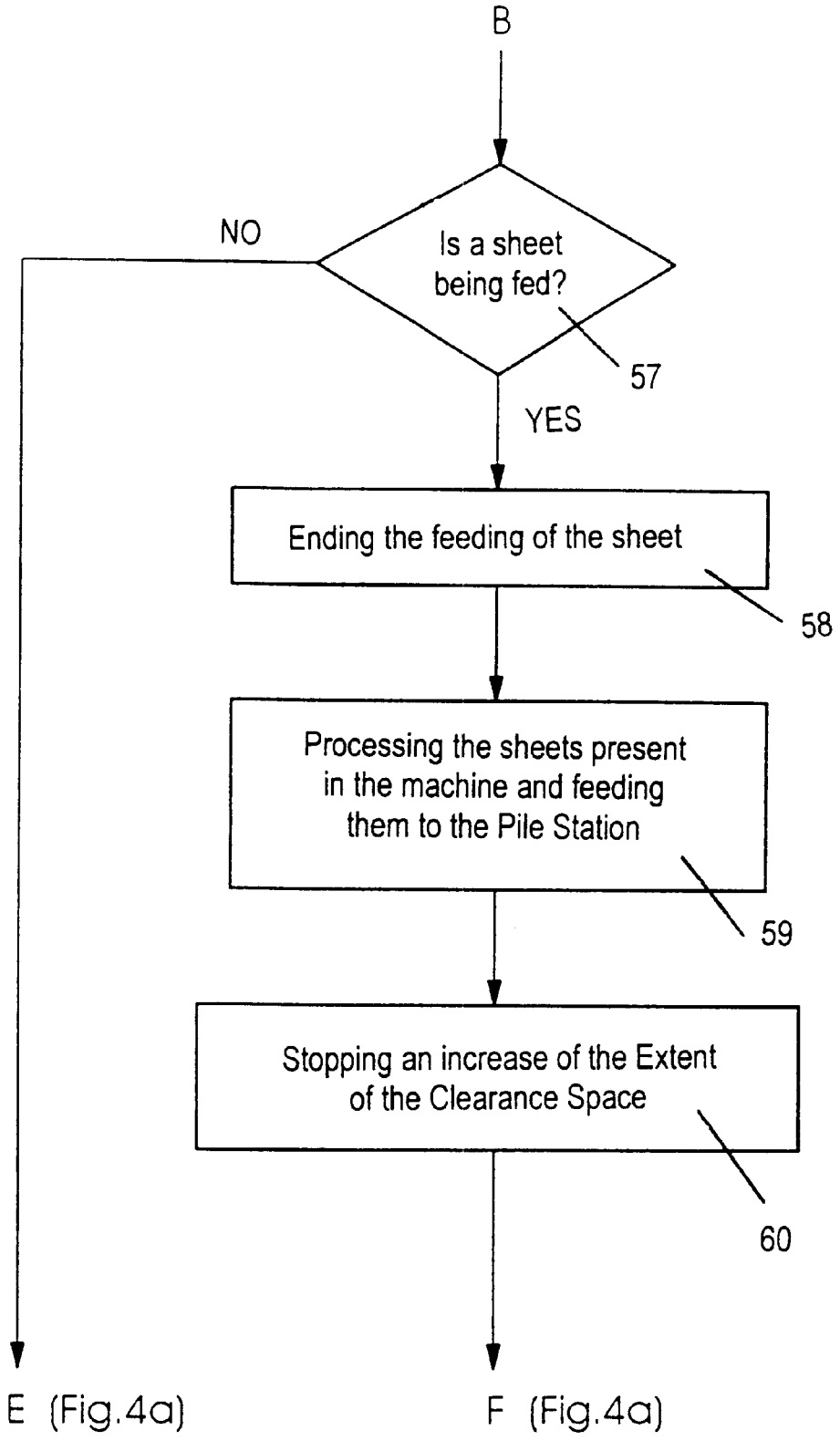

The flow chart shown in FIGS. 4*a*, 4*b* and 4*c* summarize in detail the steps taken in performing the method of operating. the sheet-processing machine in accordance with the invention.

Starting at 40, the question is raised as whether the drive is in operation at 41. If it is in operation, the further question is raised at 42 as to whether the extent of the clearance space is greater than a prescribed or predetermined value. If the answer is yes, another question is presented at 43 as to whether the space divider is present. If yes, a query is presented at 44 as to whether the space divider is forcibly bringable into a nominal position. If the answer is positive, the divider is brought forcibly into a nominal position at 45, and a question is raised at 47 as to whether the space divider is in a nominal position which, when answered in the affirmative, results in the instruction to maintain the operation of the drive at 48, and a return to 42 occurs for further action. If the answer to the question at 42 had been no, there would have been a direct response to 48. If the answer to the question at 44 is negative, the divider is brought manually into a nominal position, followed by the inquiry at 47 which, if answered by yes, then goes to 48 and returns to 42. If the answer to the query at 47 is no, there follows, at 49, forcibly stopping the drive and/or keeping it stopped, succeeded by reducing the extent of the clearance space at 50, followed at 51 by the query "Is the extent of the clearance space less than a prescribed or predetermined value swered ?" which, when answered yes, calls for releasing the drive and/or keeping it released at 52, and returning to the start at 40. If the answer to the question at 51 is negative, the flow is returned to 50.

If the answer to the query at 41 is no, another query follows at 53 as to whether the extent of the clearance space is greater than a prescribed or predetermined value. A further query at 54, following a yes to the query at 53, asks if there is present a space divider forcibly bringable into a nominal position. If the answer is yes, the space divider is forcibly brought into a nominal position at 55, followed by a query as to whether the space divider is in a nominal position at 56, followed in the affirmative by a return to 52 and subsequently to the start 40. If the query at 53 is answered by no, it is also followed by a return to 52 and subsequently to the start 40. If the queries at 54 and at 56 are no, there are returns to 49.

If the answer to the query at 43 is no, a further query is raised at 57 as to whether a sheet is being fed, followed in the affirmative by successive steps at 58 for ending the feeding of the sheet, at 59 for processing the sheets present in the machine and feeding them to the pile station, and at 60 for stopping an increase of the extent of the clearance space, followed by a return to 49. If the answer to the query at 57 is no, there is also a return to 49.

I claim:

1. A method of operating a sheet-processing machine having a sheet-pile station, a sheet conveyor for feeding sheets to the sheet-pile station and for releasing the sheets thereat during operation, the sheet conveyor defining therebeneath a clearance space extending downwardly with a magnitude depending upon the operating state of the machine, and a drive operatively connected to the sheet conveyor, which comprises detecting extents of the clearance space in a vertical direction which exceed predeterminable values, and, after the drive has been stopped, forcibly keeping the drive stopped for as long as the vertical extent of the clearance exceeds a predetermined value.

2. The method according to claim 1, which comprises forcibly stopping the drive after a prior startup thereof, if the extent of the clearance space exceeds a predetermined value.

3. The method according to claim 1, which comprises, after a prior startup of the drive, for an extent of the clearance space beyond a predetermined value, forcibly feeding to the sheet-pile station only those sheets which were on the way for sheet processing, and then forcibly stopping the drive.

4. The method according to claim 3, which comprises, during the feeding of those sheets to the sheet-pile station, which were on the way to sheet processing, preventing the extent of the clearance space from being increased in size.

5. The method according to claim 1, which comprises introducing into the clearance space a divider that is bringable into and removable out of the clearance space, the extent of the clearance space being limited to a predetermined value.

6. A method of operating a sheet-processing machine having a sheet-pile station, a sheet conveyor for feeding sheets to the sheet-pile station and for releasing the sheets thereat during operation, the sheet conveyor defining therebeneath a clearance space extending downwardly with a magnitude depending upon the operating state of the machine, and a drive operatively connected to the sheet conveyor, which comprises detecting extents of the clearance space in a vertical direction, which exceed predeterminable values, and forcibly reducing to a predetermined value an extent of the clearance that exceeds a predetermined value.

* * * * *